US005355274A

United States Patent [19]

Marach et al.

[11] Patent Number: 5,355,274

[45] Date of Patent: Oct. 11, 1994

[54] FUSED DISCONNECT

[75] Inventors: David R. Marach, Marengo; Conrad Alfaro, Chicago; Lawrence Happ, Mundelein, all of Ill.

[73] Assignee: Cooper Industries, Inc., Houston, Tex.

[21] Appl. No.: 788,199

[22] Filed: Nov. 5, 1991

[51] Int. Cl.[5] ..... H01R 7/02

[52] U.S. Cl. ..... 361/104; 361/103; 361/833

[58] Field of Search ..... 361/104, 349, 430, 431, 361/103, 106, 91; 337/196, 212, 213

[56] References Cited

U.S. PATENT DOCUMENTS 4,222,627 9/1980 Cox et al. ..... 361/349
4,543,557 9/1985 Schaefer ..... 337/196

*Primary Examiner*—A. D. Pellinen
*Assistant Examiner*—S. Jackson
*Attorney, Agent, or Firm*—Laff, Whitesel, Conte & Saret, Ltd.

[57] ABSTRACT

A fused disconnect device constructed according to the present invention comprises a housing, a line side terminal, a load side terminal, a protection fuse holder assembly removably installed in a cavity of said housing, and a separate alarm fuse removably installed in said housing. The alarm fuse may remain installed in the housing regardless of the presence of the protection fuse holder assembly, so that an alarm will be generated whenever the inventive device has interrupted power to the load. In a first embodiment of the invention, the disconnect device is adapted for front-access mounting in a power distribution panel. In a second embodiment of the invention, the disconnect device is adapted for rear-access mounting in a power distribution panel. A third embodiment is adapted for use in higher-current applications.

24 Claims, 6 Drawing Sheets

Fig. 4
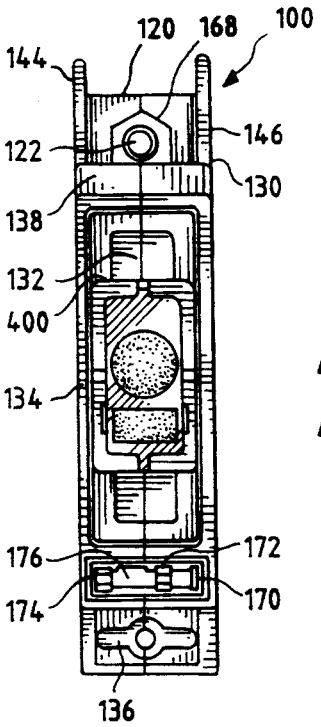
Fig. 5
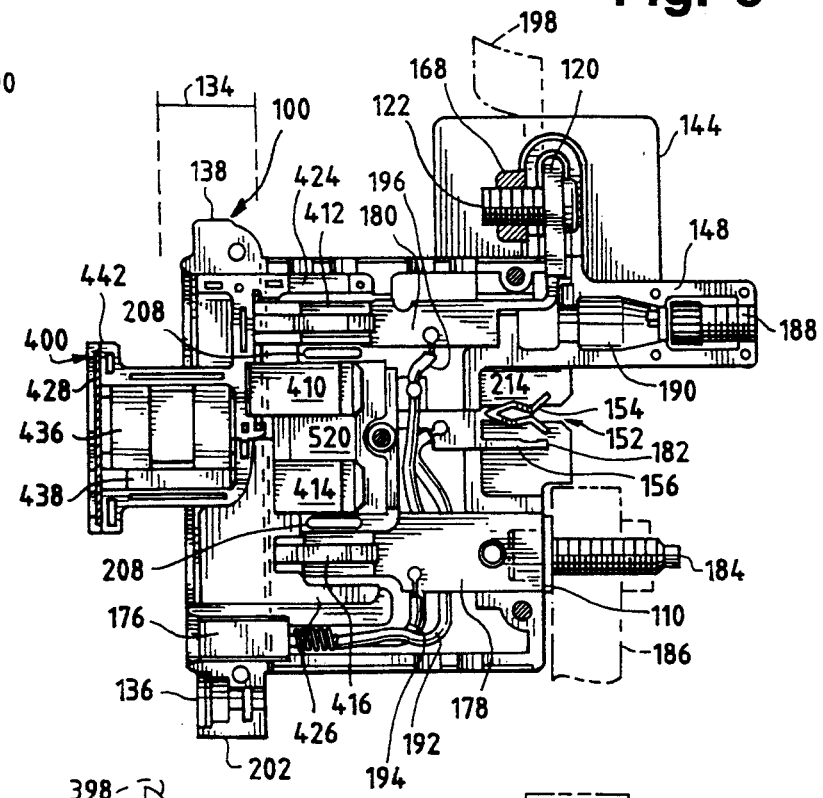
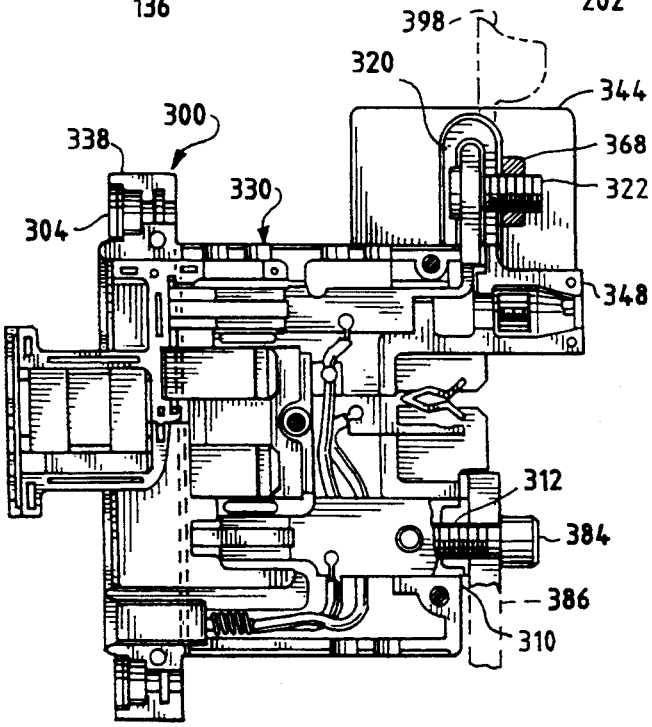
Fig. 6
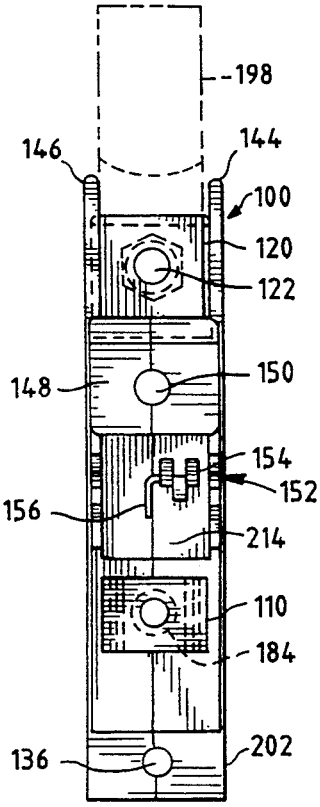
Fig. 7

Fig. 8
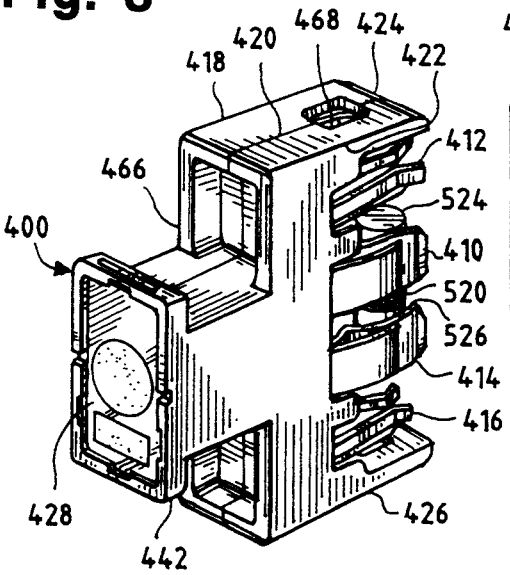
Fig. 13
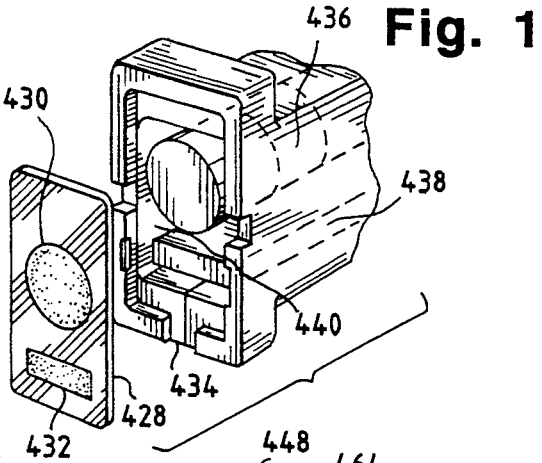
Fig. 11
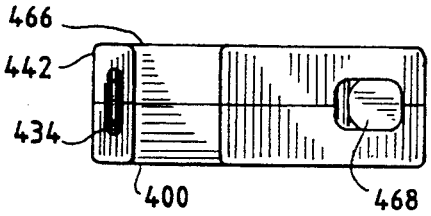
Fig. 14
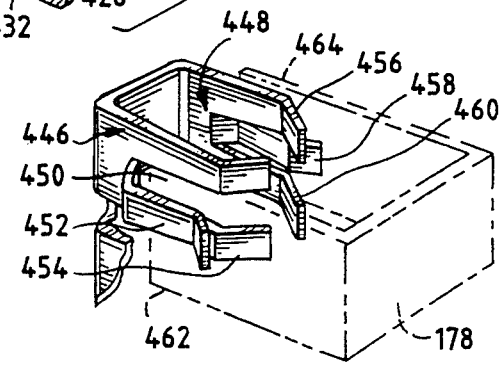
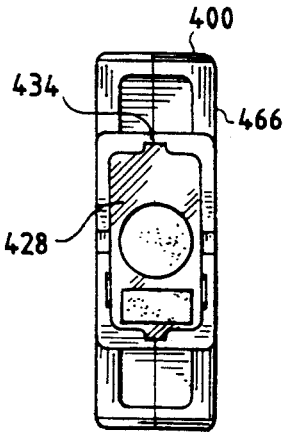
Fig. 9
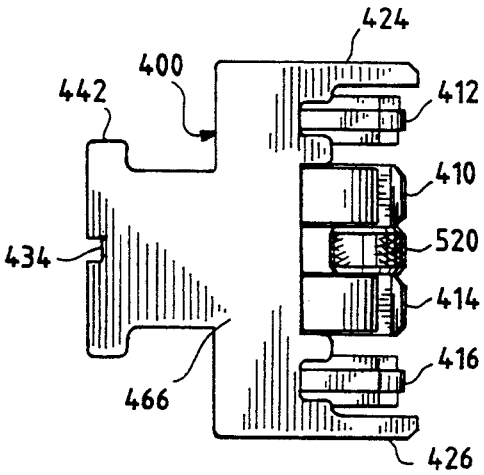
Fig. 10
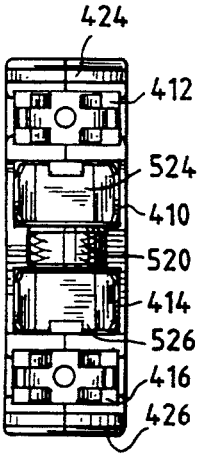
Fig. 12

FUSED DISCONNECT

BACKGROUND OF THE INVENTION

This invention relates to low voltage, high current electrical power distribution systems, and more particularly to fuse-protected electrical disconnect devices for use in electrical power distribution systems.

A common problem in the telecommunications industry and in other industries is the distribution of relatively low voltage, relatively high current electrical power to the various devices and equipment which require such power. Telecommunications systems plants, such as telephone switching offices, are typically centralized and are therefore are constructed on a large scale to serve many customers. Since telephone systems must be highly reliable, such plants usually have a plurality of high-capacity storage batteries to provide electrical power for operating equipment whenever power is not available from conventional sources. Often, the batteries are connected in parallel with suitable power conversion equipment which receives electrical power (typically high-voltage AC) from the commercial electric utility and supplies converted power (low-voltage DC) for operating all equipment and for maintaining the batteries in a charged condition. Whenever power from the conventional sources becomes unavailable, power is immediately and automatically supplied from the batteries.

In such systems, several batteries and power converters are usually connected together so that large amounts of equipment are usually supplied with power from a large collection of power sources. It is desirable in such systems to be capable of isolating individual pieces of equipment (or small groups thereof) from the power supply to perform maintenance and installation activities. It is also desirable to provide overload protection for equipment on an individual basis. Accordingly, power is conventionally distributed to equipment from distribution panels having a plurality of individual fused disconnect devices. Each disconnect device controls power to a relatively small load—for example, a cabinet containing subscriber loop interface circuits for 100 subscribers and drawing 10–50 Å in normal operation.

In large installations, multiple levels of power distribution are arrayed such that a single larger fused disconnect is used to distribute power to smaller fused disconnects. Large fused disconnect devices can generally go to 600 Å.

In the past, several fused disconnect devices have been developed to allow manual control of each load circuit, and to provide overload and fault protection of each load circuit. Such devices have typically included a line side terminal for a wired connection to a power supply bus, a load side terminal for a wired connection to a load device, a housing, and a removable fuse-containing cartridge which, when installed in the housing, provides an electrical connection between the line side terminal and the load side terminal. Some of these prior art device have also included an indicator fuse disposed in the removable cartridge and connected in parallel with the main fuse. When the main fuse interrupted the circuit, the alarm fuse would complete an subsidiary alarm circuit between the line side terminal and an alarm terminal. The alarm terminal could be monitored for remote indication of a fault.

These prior art devices have a variety of disadvantages. Telecommunications systems are often incrementally expanded. Because customers expect their telecommunications services to be continuously available, it is often necessary to add power circuits in a distribution panel while existing circuits are operating. The rear side of a power distribution panel typically contains uninsulated bus bars and various other uninsulated conductors. Because the panel is supplied with power from batteries and other low-impedance sources, extremely high currents (in the range of 10,000 to 100,000 Å) are available in case of a fault. Installation of disconnect devices from the rear side of the panel may be highly dangerous, since there is a reasonable chance that a conductive tool or part may be accidentally dropped, thereby causing a fault. It is therefore highly desirable to install disconnect devices from the front of the panel.

Generally fused disconnect devices used are not adapted for installation from the front of the power distribution panel. Because of the arrangement of terminals on the prior art disconnects, access from the rear of the panel is generally required.

Another disadvantage of the prior art devices is that their terminal arrangement requires wired connections between the line side terminal and the power supply bus bar. Such wired connections are labor intensive, require expensive parts, and generally require access from the rear of the panel.

Another disadvantage is that in prior art devices providing an alarm fuse, that fuse is contained in the removable fuse-holding disconnect cartridge. Accordingly, if a craftsperson removes the cartridge to disconnect power to a load device, there is no mechanism for generating an alarm signal. Furthermore, when a disconnect fuse has interrupted power to a load device due to an overload or fault condition, merely removing the fuse-holding cartridge is sufficient to defeat the alarm. Accordingly, if a craftsperson removes a cartridge from the prior art disconnect devices and fails to replace it, the equipment served thereby may remain without power for an indeterminate period, and the lack of an alarm signal will conceal that fact from remote monitoring displays.

OBJECTS AND SUMMARY OF THE INVENTION

It is therefore an object of the present invention to provide a fused disconnect device which is adapted for front or rear mounting in a power distribution panel.

It is another object of the present invention to provide a fused disconnect device which avoids the need for a wired connection between the device and a power supply bus conductor.

It is a further object of the present invention to provide a fused disconnect device which provides an alarm signal when power is interrupted to a load device without regard to the presence of a protection-fuse-holding cartridge.

A fused disconnect device constructed according to the present invention comprises a housing, a line side terminal, a load side terminal, a protection fuse holder assembly removably installed in a cavity of said housing, and a separate alarm fuse removably installed in said housing. The alarm fuse may remain installed in the housing regardless of the presence of the protection fuse holder assembly, so that an alarm will be generated whenever the inventive device has interrupted power to the load. The fuse holder assembly comprises a cavity for holding at least one spare protection fuse and one spare alarm fuse. A cover retains the spare fuses in the cavity until they are required. The cover is marked to indicate the fuse ratings while permitting an observer to view the contents of the cavity. In a first embodiment of the invention, the disconnect device is adapted for front-access mounting in a power distribution panel. The line side terminal is adapted for direct contact with a power supply bus bar. A fastener which is accessible from the front of the device secures the line side terminal to the bus bar. A fastener on the load side terminal extends toward the front of the device so that a load conductor may be installed on that terminal using only front access. Mounting fasteners, including fasteners extending from a rear portion of the device, are each accessible from the front. In a second embodiment of the invention, the disconnect device is adapted for rear-access mounting in a power distribution panel. The line side terminal is adapted for direct contact with a power supply bus bar. A fastener extends from the rear of the bus bar through the bar and into a receptacle in the device in order to secure the line side terminal to the bus bar. A fastener on the load side terminal extends toward the rear of the device so that a load conductor may be installed on that terminal using only rear access. A third embodiment is adapted for use in higher-amperage applications.

BRIEF DESCRIPTION OF THE DRAWINGS

These and other features of this invention will be best understood by reference to the following detailed description of a preferred embodiment of the invention, taken in conjunction with the accompanying drawings, in which:

FIG. 4 is a front elevation view of the disconnect device of FIG. 1;

FIG. 5 is a right-hand side elevation view of the disconnect device of FIG. 1, showing the right-hand-side cover removed to reveal the internal construction details of the device;

FIG. 6 is a right-hand side elevation view of a second embodiment of the a fused disconnect device constructed according to the present invention, showing the right-hand-side cover removed to reveal the internal construction details of the device;

FIG. 7 is a rear elevation view of the disconnect device of FIG. 1;

FIG. 8 is an oblique perspective view of a fuse holder component of the disconnect devices, of the present invention;

FIG. 9 is a front elevation view of the fuse holder component of FIG. 8;

FIG. 10 is a side elevation view of the fuse holder component of FIG. 8;

FIG. 11 is a top plan view of the fuse holder component of FIG. 8;

FIG. 12 is a rear elevation view of the fuse holder component of FIG. 8;

FIG. 13 is an partial oblique perspective, partial cutaway view of the fuse holder component of FIG. 8, showing a front protective cover thereof detached to reveal the interior of the component;

FIG. 14 is an oblique perspective view of a terminal for use in the fuse holder component of FIG. 8;

DETAILED DESCRIPTION OF THE PREFERRED EMBODIMENT

Figure 16:
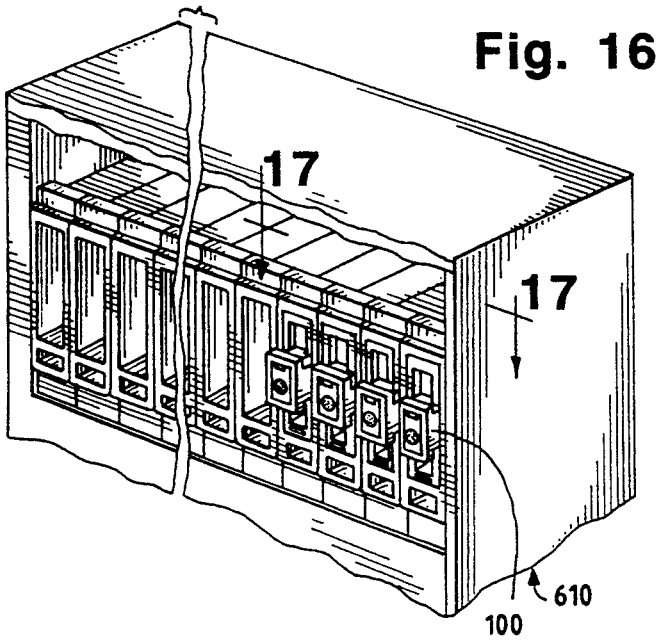
FIG. 16 is a front perspective view of a power distribution panel showing an application of the present invention.
Figure 18:
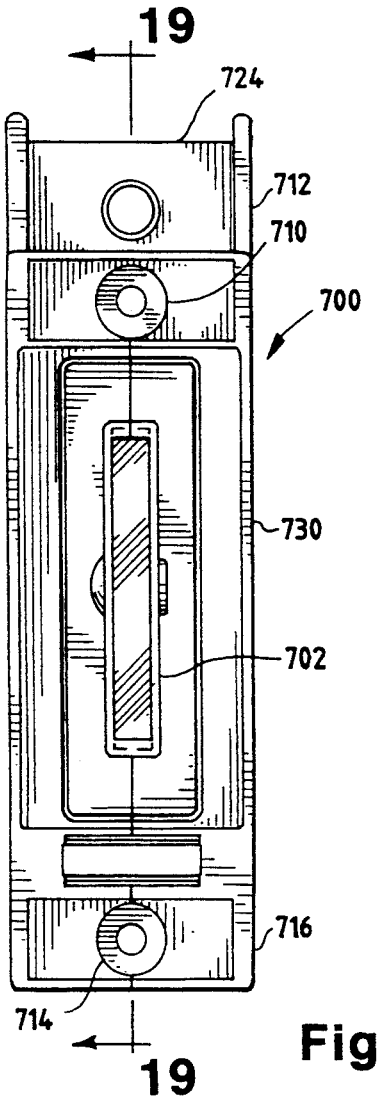
FIG. 18 is a front elevation view of a third embodiment of a fused disconnect device constructed according to the present invention.
Figure 17:
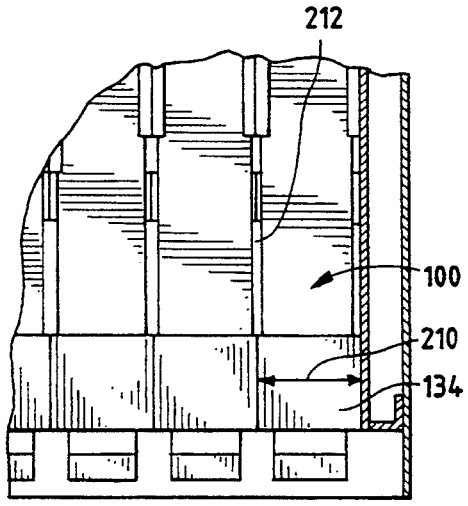
FIG. 17 is a top cross-section view of the power distribution panel of FIG. 16 taken along the view lines 17—17 thereof.

Preferred embodiments 100, 300, 700 of a fused disconnect device constructed according to the present invention are shown in FIGS. 1, 3–7, and 18–22. The disconnects 100, 300 are adapted for use in relatively low voltage (6–50 V DC) power supply applications in which the maximum load current may range from 1 to 70 Å. However, the principles used to provide these disconnects can be utilized to provide a disconnect for larger amperage circuit protection as hereinafter described in FIGS. 18–22. The disconnects 100, 300, 700 are designed for installation in a suitable power distribution panel or enclosure (see FIGS. 16–18). The first disconnect 100 (FIGS. 1, 3–5, and 7) is adapted for installation from the front side of the power distribution panel. The second disconnect 300 (FIG. 6) is adapted for installation from the rear side of the power distribution panel. Since the first and second disconnects are similar, the front installation disconnect 100 will be first described in detail, and the differences between that disconnect and the rear installation disconnect 300 will then be explained. Accordingly, references herein to the first disconnect 100 may generally be applied to the second disconnect 300 except as contradicted in the description of the second disconnect (see FIG. 6).

Figure 1:
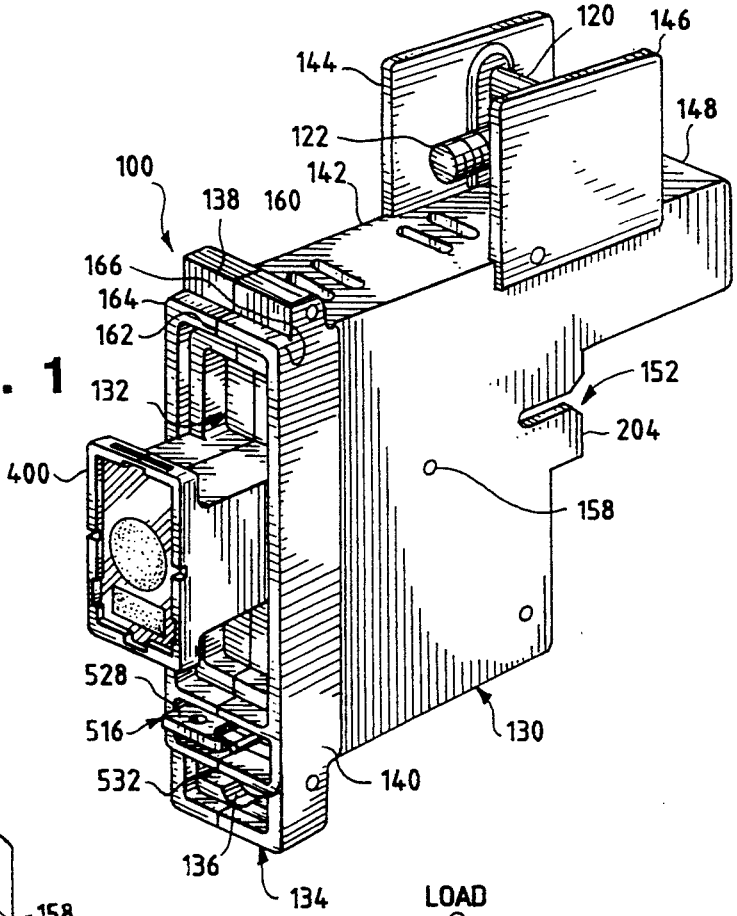
FIG. 1 is an oblique front perspective view of a first embodiment of a fused disconnect device constructed according to the present invention.
Figure 3:
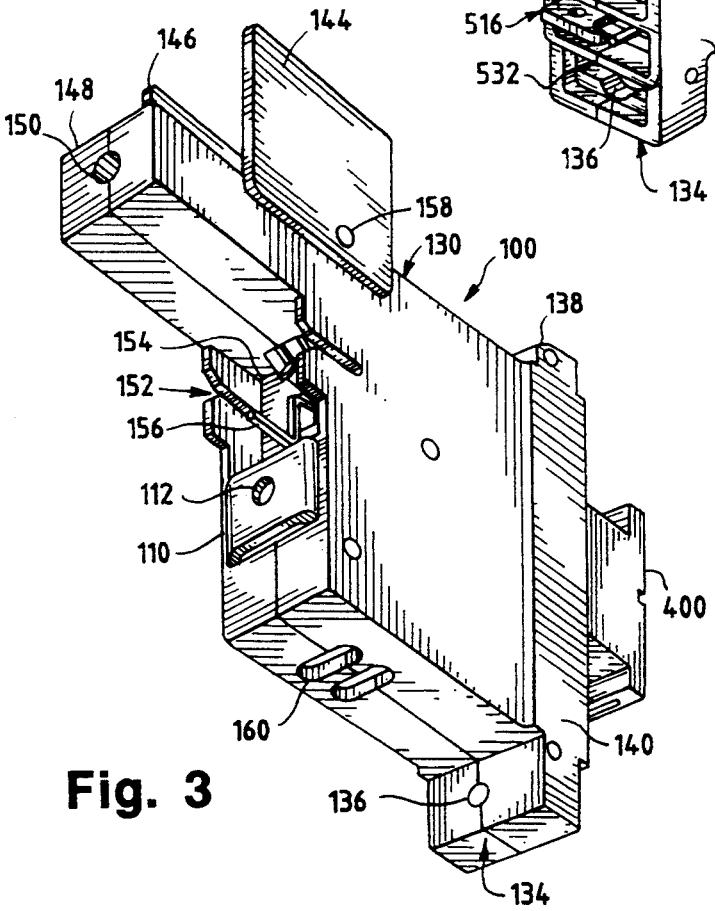
FIG. 3 is an oblique rear perspective view of the disconnect device of FIG. 1.
Figure 2:
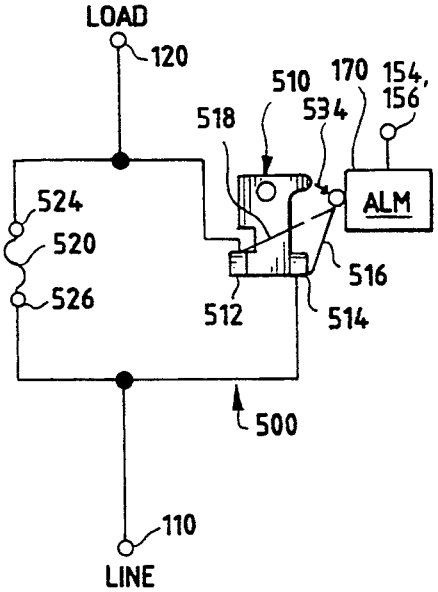
FIG. 2 is a partial schematic, partial block diagram of the electrical circuit formed by the disconnect device of FIG. 1.

As best seen in FIGS. 1, 3–5, and 7, fused disconnect 100 comprises a housing or enclosure 130, a line side terminal 110, a load side terminal 120, a load protection fuse holder assembly 400, an alarm or indicator fuse 510, and alarm terminals 154, 156. An electrical schematic of the circuit 500 formed by fused disconnect 100 is shown in FIG. 2. In a typical application, the line side terminal 110 is connected to a power source, and the load side terminal 120 is connected to a load device (not shown) to be protected by the disconnect 100.

A protection fuse 520 i.e. cartridge fuse (FIGS. 2, 10, 12) is electrically connected across the line side terminal 110 and the load side terminal 120 to permit current to flow therebetween. An alarm and indicator fuse 510 is connected in parallel with fuse 520—i.e. across the line side terminal 110 and the load side terminal 120. The alarm fuse 510 is also connected to alarm terminals 154, 156.

Fuse means 520 is preferably a telecommunication fuse element having appropriate electrical ratings to protect the specific load device with which the disconnect is used. For example, fuse 520 is preferably a cartridge type fuse, which is available from the BUSSMANN division of Cooper Industries, Inc. As will be discussed later in greater detail, fuse 520 is removably installed in the load protection fuse holder assembly 400 (FIGS. 1, 8, 10, 12). The fuse holder assembly 400 is removably installed in the disconnect housing. When the fuse holder assembly 400 is removed from the disconnect 100, the fuse means 520 is electrically disconnected from the line and load side terminals 110 and 120. An operator may use this feature to manually disconnect the load device from the power source supplied to the line side terminal. The current path provided by fuse means 520 will also be interrupted when excessive load current flows through the fuse, thereby causing an element therein to melt or break.

Figure 15:
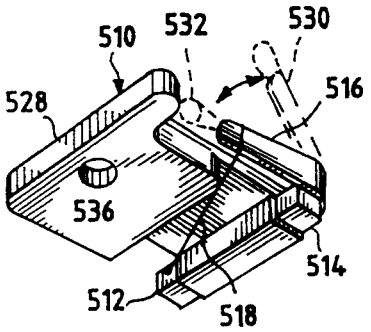
FIG. 15 is an oblique perspective view of an alarm fuse component for use in the disconnect devices of the present invention.

The alarm fuse 510 (FIGS. 1, 2, 15) is removably installed in disconnect housing 130 and provides a signal at alarm terminals 154, 156 when the current path provided by the protection fuse 520 has been interrupted. Such an interruption may occur as a result of either overload operation of fuse 520 or manual removal of the fuse holder assembly 400 by an operator. As best seen in FIG. 15, the alarm fuse preferably has a line side contact 514, a load side contact 512, a resilient operating member 516 electrically connected to the line side contact 514, a fusible element 518 electrically connected between the load side contact 512 and the resilient operating member 516, and an alarm contact 170. For proper operation, the current rating for the alarm fuse 510 is preferably selected to be substantially lower than the normal operating current of the load device to be protected. Alarm fuse 510 is preferably a conventional indicating fuse element of a suitable rating. For example, fuse means 510 is preferably a GMT type indicator fuse, which is commercially available from the BUSSMANN division of Cooper Industries, Inc.

In typical operation of the inventive disconnect 100, a suitable power supply is connected to the line side terminal 110, and a non-faulty load device (not shown) is connected to load side terminal 120. Protective fuse 520 and alarm fuse 510 are in their initial, conducting conditions. In the initial condition of alarm fuse 510, operating member 516 is resiliently biased in the direction of arrow 534, but is mechanically retained in a position 536 (FIG. 15) spaced from alarm contact 170 by fusible element or fuse link 518.

If a fault or overload occurs either in the load device or wiring on the load side of the disconnect 100, excessive current will flow through fuse means 520, causing that fuse to interrupt its current path. Since the alarm fuse 510 is connected in parallel with the protection fuse 520, when the protection fuse 520 interrupts its current path, the entire load current will flow through the alarm fuse 510. Because the alarm fuse 510 has a relatively low current capacity (compared to even the non-overload current drawn by the load device), its fusible element or fuse link 518 melts or breaks immediately, interrupting the electrical path between the line side terminal 110 and the load side terminal 120. Once element 518 melts, the resilient member 516 is released and is urged into engagement with the alarm contact 170 (position 530, FIG. 15), thereby electrically connecting that contact with the line side terminal 110. This produces an alarm signal on alarm terminals 154, 156 which may be connected to suitable remote monitoring or indication devices.

An operator may manually disconnect power from the load side terminal 120 by removing the protection fuse holder assembly 400 from the disconnect housing 130. The fuse holder 400 includes the protection fuse means 520, so that when the fuse holder 400 is removed, the high-current electrical path incorporating fuse means 520 is interrupted. Although the alarm fuse 510 is connected in parallel with the protection fuse 520, the current capacity of the alarm fuse 510 is very low compared to even the normal load current drawn by the load device. Accordingly, element 518 of alarm fuse 510 melts or breaks immediately, interrupting the electrical path between the line side terminal 110 and the load side terminal 120, and producing the alarm signal on alarm terminals 154, 156.

Because the inventive disconnect device 100 locates the alarm fuse means 510 in the disconnect housing 130 instead of the protection fuse holder 400, the alarm fuse 510 operates to generate an alarm signal without regard to whether the protection fuse holder 400 is installed. This provides a significant advantage over prior-art disconnect devices which incorporated an alarm fuse in a removable fuse holder. In such prior art devices, once the protection fuse holder was removed, the alarm signal connection was defeated. Such behavior caused significant problems. First, a craftsperson could use the disconnect device to remove power from a device without ever producing an alarm, and power could remain disconnected from the load device for lengthy periods without producing an alarm. Second, when the protection fuse interrupts due to fault or overload, the alarm thereby produced would be cleared by merely removing the protection fuse holder, even if power is never reconnected to the load device.

In contrast, whenever the inventive disconnect device 100 removes power from the load device, either through manual removal of the protection fuse holder or through overload or fault operation of the protection fuse 520, the device produces an alarm signal continuously until the condition producing the alarm is successfully cleared.

As best seen in FIGS. 1, 3–5, and 7, the first disconnect 100 according to the present invention includes a housing 130 for containing and supporting the electrical components of the device. The housing and other mechanical aspects of the disconnect device 100 are constructed to allow the device to be conveniently and inexpensively installed in modern, high-density power distribution panels and to allow installation to be accomplished from the front side of such panels. In the preferred embodiment, the shell portions are constructed of a flame-retardant glass-filled thermoplastic polyester which is available from DuPont of Wilmington, Del., as RYNITE, type "530 FR". However, other materials could also be used.

The housing 130 is preferably constructed by forming separate shell portions 164, 166 which may be assembled together to form a complete housing 130. Ally suitable process, such as molding, may be used to form the housing portions 164, 166. Once the shell portions have been formed and internal parts have been installed, the shell portions are preferably fastened together using suitable fastening means 158. For example, in the preferred embodiment, rivets are preferred for use as fastening means 158, but other means, such as adhesives, welding, or other conventional fasteners could also be used. The intersection of the shell portions 164, 166 may form a seam 162. The shell portions are preferably constructed of a suitable insulating plastic which is strong and durable and which is capable of withstanding moderately elevated temperatures. In the preferred embodiment, the shell portions are constructed of a flame-retardant glass-filled thermoplastic polyester which is available from DuPont of Wilmington, Del., as RYNITE, type "530 FR". However, other suitable materials could also be used.

The housing 130 has a front panel interface section 134 which extends forward from suitable mounting means forming a part of the power distribution panel and part of which is visible from the front of the panel. The front panel interface section 134 has substantially rectangular walls 140. The width 210 (FIG. 17) of section 134 is slightly greater than the width of the remainder of the housing 130 to form a gap 212 between adjacent devices 100 mounted in the panel. The gap 212 provides ventilation and prevents overheating which might otherwise occur due to relatively high currents which may be carried by the device.

A lower mounting ear extends downward from the housing 130 to allow attachment of the housing to a structural member of the panel. An aperture 136 preferably extends through the mounting ear 202 to receive appropriate mounting fasteners (not shown). The mounting fasteners preferably mate with suitable means for capturing the fastener in the panel structural member. A small tab 138 may extend upward from section 134 to house a fastener means 158 for securing housing shell portions 164, 166 to one another following assembly. Preferably, the height of tab 138 is limited so that it does not interfere with access to mounting components located to the rear of the tab, because such access is needed for front mount installation of the disconnect device.

The housing 130 comprises a substantially rectangular cavity 132 for removably receiving the protective fuse holder assembly 400. The cavity 132 includes barrier walls 208 (FIG. 5) which are shaped to complement portions of the fuse holder assembly 400 to ensure correct orientation of the assembly 400 upon insertion into the cavity. Barrier walls 208 are also used to prevent possible contact across terminals 110 and 180 when power is present, i.e., these barriers serve as installers' security devices. The housing 130 preferably also comprises a GMT fuse housing 176 for receiving an alarm fuse 510. As best seen in FIG. 1, the alarm fuse means 510 preferably has a handle portion 528 to permit the alarm fuse means 510 to be removed for inspection or replacement. In addition, the alarm fuse means 510 may also have an indicator knob to permit craftspersons to visually determine the state of the fuse without removal from the fuse housing 176. Also the alarm fuse may have a clear plastic cover snapped onto the alarm fuse.

The housing 130 has upper and lower wall surfaces 142 extending rearward from the front panel section 134. A plurality of ventilation apertures 160 are preferably provided in the upper and lower wall surfaces 142. The ventilation apertures 160 prevent overheating which might otherwise occur due to relatively high currents which may be carried by the electrical conductors within the enclosure.

A load side terminal 120 extends upward from the top surface 142 of the enclosure 130. During installation of the disconnect device 100, a suitable load conductor 198 is electrically connected to the load side terminal 120 and carries electrical power from disconnect 100 to a load device (not shown). The first embodiment of the disconnect 100 is preferably adapted to permit device installation into a power distribution panel from the front of the panel. Accordingly, a suitable fastener means 122 preferably extends forward from the load side terminal 120 to permit installation of the load conductor 198 (FIG. 5) on the front side of the terminal 120. For example, during manufacturing, a threaded bolt or stud may be pressed through an aperture in the terminal 120 from the rear so that a significant portion of the stud extends forward of the terminal. During installation, the load conductor 198 may then be installed over the bolt and compressed into secure engagement with the terminal 120 using a matching nut 168. Other fastener means could also be used.

Barrier plates 144, 146 are disposed parallel to the side walls of the enclosure 130 and extend upward from upper surface 142. The barrier plates 144, 146 provide a mechanical and electrically insulating barrier between the conductor 198 and any nearby conductors and terminals to prevent short circuits which could occur due to loosening of previously installed conductors or due to installation activities. Barrier plates 144 and 146 are outwardly placed from side walls of the enclosure to provide the gap 212 (FIG. 17) referred to previously. The distance between the outer surface of barriers and the side walls of the enclosure 130 is substantially equal to the distance between the wall 140 and the side walls of the enclosure 130.

A mounting projection 148 extends rearward from the housing 130 to provide an additional position for securing the housing 130 to a structural member in the distribution panel 610. An aperture 150 (FIG. 3) is provided in the projection to receive a suitable fastening means 188 (FIG. 5). For example, fastening means 188 may be a threaded bolt extending rearward through the aperture 150 to engage a mating hole in a structural member (not shown) of the distribution panel 610. The walls of projection 148 preferably form a cavity 190 extending from the rear of the projection to the fuse holder cavity 132. This allows access to the fastening means 188 from the front of the panel (with fuse holder assembly 400 removed), thereby permitting installation of the disconnect device 100 from the front of the panel.

The distribution panel 610 preferably has an appropriate bus bar 186 (FIG. 5) for supplying power to the line side contact 110 of the disconnect device 100. Prior to installation of the disconnect device 100 into the panel, suitable mounting apertures are preferably provided in the bus bar 186 to receive a fastener means 184 for securing the line side contact 110 in tight mechanical and electrical contact with the bus bar 186. For example, the fastener means 184 may be a threaded bolt extending rearward from the interior of the housing 130 through an aperture 112 in the line side contact 110. Preferably, an unobstructed access path is provided through fuse holder cavity 132 to the fastener means 184 to permit installation of the disconnect device 100 from the front of the distribution panel 610.

In order to receive an alarm signal from the disconnect device 100, the distribution panel 610 may have a suitable alarm bus bar position for automatic connection to alarm terminal 154 or hand wired to alarm post 156.

As best seen in FIGS. 5 and 7, alarm terminal 154 has an alternating trifurcated configuration for straddling a blade- or bar-type contact. The trifurcated terminal has three contact leaves extending rearward from the housing 130. Two spaced contact leaves are resiliently biased toward a third intermediate contact leaf. A blade or bar contact may be received between the third contact leaf and the remaining two contact leaves, thereby creating at least three independent regions of contact between the blade and the contact leaves to provide a highly reliable connection.

Since the alarm signal is not required to carry significant amounts of current, the alarm terminals 154, 156 are preferably constructed of a relatively light gauge, conductive metal. However, such contacts may be deformed or damaged during handling and shipping of the disconnect device. Accordingly, the alarm terminals 154, 156 are preferably disposed in a recess 214 in the bottom of housing 130 to protect them from such damage. A small notch 152 is provided in the side walls 204 of the recess to permit the alarm bus bar to penetrate the recess 190 without interfering with the walls.

In some applications, it may be desirable to individually wire the alarm signal from each disconnect 100 to equipment for monitoring the alarm signals. In other applications, an alarm bus bar may not be provided in the distribution panel 610. Accordingly, an additional alarm terminal 156 is provided on the disconnect device for accepting a wired connection. Preferably, the alarm terminal 156 has a square cross section compatible with conventional wire-wrapping techniques, and an end notch 182 for capturing a portion of a wire if a solder connected is used.

Internal to the housing 130, a plurality of electrical contacts and conductors are provided to receive mating contacts on protection fuse holder assembly 400 and alarm fuse means 510, and to connect these contacts to the external line side contact 110, load side contact 120, and alarm contacts 154, 156, as appropriate.

A first contact 178 is provided in the fuse holder cavity 132 for engaging a mating contact 416 of the fuse holder assembly 400. The first contact 178 is electrically connected to the line side terminal 110. Items 110 and 178 are preferably constructed as a single piece extending forward through the rear wall of the housing 130 into the fuse holder cavity 132. As best seen in FIG. 14, first contact 178 is preferably formed as a modified-U-shaped contact having two forward-extending blade contact portions 462, 464.

A second contact 180 is provided in the fuse holder cavity 132 for engaging a mating contact 412 of the fuse holder assembly 400. The second contact 180 is electrically connected to the load side terminal 120. Items 120 and 180 may be constructed as a single piece extending forward through the rear wall of the housing 130 into the fuse holder cavity 132. Second contact 180 is preferably formed as a modified-U-shaped contact having two forward-extending blade contact portions, in a manner similar to the construction of first fuse holder contact 178.

As best seen in FIG. 4, first, second, and third contacts 172, 174, and 170 are provided in the alarm fuse cavity 176 for respectively engaging mating line side, load side, and alarm contacts 514, 512, and 516 (FIG. 2) of the alarm fuse means 510. As best seen in FIG. 5, the first contact 172 is electrically connected to line side terminal 110 by a conductor 194. The second contact 174 is electrically connected to the load side terminal 120 by a conductor 196. The third contact 170 is electrically connected to the alarm terminals 154, 156 by a conductor 192. Conductors 192, 194, 196 are preferably insulated wires, but any other suitable conductor could also be used.

A fuse holder assembly 400 used in the disconnect 100 according to the present invention is shown in greater detail in FIGS. 8–14. The assembly 400 is inserted into the fuse holder cavity 132 of the disconnect 100 to complete an electrical connection between the line side terminal 110 and the load side terminal 120, thereby permitting electrical power to pass to a load device. Electrical power to the load device may be interrupted by manually removing the fuse holder assembly 400. In addition, the fuse holder assembly 400 incorporates a protection fuse to automatically interrupt electrical power to the load device if an overload or fault condition occurs.

The fuse holder assembly 400 comprises a body 466, and protection fuse 520, first and second contacts 410, 414 for electrically connecting to and for mechanically securing the fuse 510, and first and second terminals 412, 416 for engaging mating contacts 180, 178 respectively of the fuse holder cavity 132.

The body 466 is preferably constructed by forming separate shell portions 418, 422 which may be assembled together. Any suitable process, such as molding, may be used to form the shell portions 418, 422. Once the shell portions have been formed and internal parts have been installed, the shell portions are preferably fastened together using suitable fastening means. For example, in the preferred embodiment, ultra-sonic welding is preferred for use as fastening means, but other means, such as adhesives, riveting, or other conventional fasteners could also be used. The intersection of the shell portions 418, 422 may form a seam 420. The shell portions are preferably constructed of a suitable insulating plastic which is strong and durable and which is capable of withstanding moderately elevated temperatures. In the preferred embodiment, the shell portions are constructed of a amorphous thermoplastic resin poly-etherimide which is available from GE Plastics of Pittsfield, Mass., under the name "ULTEM 1000". However, other materials could also be used.

The body 466 preferably incorporates a forward-extending handle portion 442 and upper and lower rearward-extending blade portions 424, 426. The handle portion 442 is shaped so that it may be grasped and pulled to remove the fuse holder assembly from the fuse holder cavity 132. According to the invention, the walls of the handle portion 442 form a cavity 440 for housing at least one spare cartridge protection fuse 436 and one spare GMT alarm fuse 438. A cover 428 retains the spare fuses 436, 438 until they are needed. The cover 428 is preferably constructed of a transparent material so that the presence or absence of spare fuses in the cavity 440 may be readily determined upon an external cursor inspection. Notches or apertures 434 are provided in the handle portion to retain the cover 428; a craftsperson may insert a tool into a notch 434 to release the cover.

Marking areas 430, 432 are preferably defined on cover 428 to allow the ratings of the spare fuse contained in the cavity 440 to be inscribed thereon. Marking areas 430, 432 may be printed using an ink or applied using a textured film which is adapted to accept markings from conventional pens and pencils. Such inks or films may be selected from those used to create signature areas on commonly used charge and credit cards. As best seen in FIG. 13, the markings areas 430, 432 are respectively shaped to correspond to the cross section of the protection fuse 436 and alarm fuse 438. The matching shapes are intended to aid the user in determining which of the ratings marked on the cover 428 corresponds to a particular spare fuse. The marking areas 430, 432 are preferably smaller than the actual cross section of their corresponding spare fuse to allow a craftsperson to view the interior of the cavity 440 despite the marking areas.

Upper and lower rearward-extending blade portions 424, 426 of body 466 are provided to protect contacts 412, 416 from damage during handling, shipping, and installation of the fuse holder assembly 400. The blade portions 424, 426 also perform a locator function by forming a substantially rectangular cross section to ensure that the fuse holder assembly is correctly oriented when inserted into the fuse holder cavity 132. Blade portions 424, 426 may have one or more apertures 468 to provide ventilation and avoid overheating which might otherwise occur due to relatively high currents which may be carried by the adjacent contacts.

The protective fuse means 520 is generally cylindrical and has first and second end caps 524, 526 which are electrically connected to a fusible element contained within the fuse 520 to provide overload and fault protection. Accordingly, the fuse holder assembly 400 has first and second fuse contacts 410, 414 to mechanically secure and electrically connect the fuse end caps 524, 526. First and second fuse contacts 410, 414 are formed as modified-U-shaped contacts, each having two forward-extending blade contact portions. The opposed contact blades are bent concavely inward and resiliently biased toward one another to securely but removably hold the fuse means 520 by end caps 524, 526.

First and second fuse contacts 410, 414 are electrically connected to first and second fuse holder terminal means 412, 416. When the fuse holder assembly 400 is inserted into the fuse holder cavity 132, the first and second fuse holder terminal means 412, 416 mechanically and electrically engage mating contacts 180, 178 therein. As best seen in FIG. 14, terminal means 412 and 416 are formed as a modified-U-shaped contact having a two opposed, rearward-extending blade portions 446, 448. Each blade portion ends in contact portions having an alternating trifurcated configuration for straddling a blade- or bar-type contact.

Each trifurcated contact portion has three contact leaves (e.g. 450, 452, 454, and 456, 458, 460) extending rearward. Two spaced contact leaves (e.g. 450 and 454) are resiliently biased toward a third intermediate contact leaf (e.g. 452). A blade or bar contact (e.g. 178) may be received between the third contact leaf (452) and the remaining contact leaves (e.g. 450 and 454), thereby creating at least three independent regions of contact between each blade contact and the contact leaves. Since each of the terminals 412, 416 has two trifurcated contact sections, each terminal provides six independent regions for contacting its mating fuse holder cavity contact 178, 180. This feature advantageously provides a highly reliable connection, since it is unlikely that all six contact regions will be simultaneously defective, improves current handling capacity, and reduces heating in the contact regions.

A second disconnect 300 constructed according to the present invention is shown in FIG. 6. This disconnect 300 is similar to disconnect 100 except that it is adapted for installation from the rear side of a power distribution panel 610. Accordingly, only the differences between the front mount disconnect 100 and the rear mount embodiment 300 will be discussed in detail; except for these differences, the embodiments are essentially identical.

As on the front mount disconnect, the load side terminal 320 extends upward from the top surface of the enclosure, and during installation of the disconnect device 300, a suitable load conductor 398 is electrically connected to the load side terminal 320. However, the contacts of the rear mount disconnect embodiment 300 are to be accessed from the rear side of the disconnect panel during installation. Accordingly, a suitable fastener means 322 preferably extends rearward from the load side terminal 320 to permit installation of the load conductor 398 on the rear side of the terminal 120. For example, during manufacturing, a threaded bolt or stud may be pressed through an aperture in the terminal 320 from the front so that a significant portion of the stud extends to the rear of the terminal. During installation, the conductor 398 may then be installed over the bolt and compressed into secure engagement with the terminal 320 using a matching nut 368. Other fastener means could also be used.

In rear-mount applications, the distribution panel 610 preferably has an appropriate bus bar 386 for supplying power to the line side contact 310 of the disconnect device 300. Prior to installation of the disconnect device 300 into the panel, suitable apertures are provided in the bus bar 386 to allow a fastener 384 to penetrate the bus bar 386 from the rear to engage a receiving fastener 312 in the line side contact 310. The receiving fastener 312 of contact 310 is preferably tapped or otherwise constructed to allow fastener means 384 to securely mechanically engage the receiving fastener 312 to urge the line side contact 310 into tight mechanical and electrical contact with the bus bar 386. For example, the fastener means 384 may be a threaded bolt extending forward through bus bar 386, and the receiving fastener 312 may be a mating bolt or a tapped aperture in the line side contact.

The rearward-extending mounting projection 148 of the front mount disconnect 100 is omitted from the rear mount disconnect 300, and the rear wall 348 of the housing is built essentially flush with the rearmost extent of insulating barrier 344. In order to provide an additional secured mounting point, a mounting ear 338 is provided which extends upward from the housing 330. This mounting ear 338 is in addition to the lower mounting ear 136 provided in both embodiments and allows attachment of the housing to a second structural member of the panel. An aperture 336 preferably extends through the mounting ear to receive appropriate mounting fasteners (not shown). The mounting fasteners preferably mate with suitable means for capturing the fastener in the panel structural member.

A third disconnect 700 constructed according to the present invention and adapted for use in higher amperage applications is shown in FIGS. 18–22. The third disconnect 700 is constructed in a manner similar to that of the previously described disconnects 100, 300, and therefore, only the significant variations are discussed in detail herein.

The third disconnect 700 comprises a housing 730, a removable fuse holder assembly 702, an alarm terminal 736, a line side terminal 726, and a load side terminal 724. As shown in FIGS. 18–22, the third disconnect is adapted for front-access mounting in an appropriate power distribution panel (not shown) having a bus bar to which the line side terminal 726 is to be attached. Accordingly, a rearward-extending fastener 718 is provided to securely mechanically and electrically attach line side terminal 726 to a pre-existing mounting aperture in the bus bar.

In front-access mounting applications, it is desirable to attach a load conductor (not shown) to the front side of the load side terminal 724. Accordingly, a forward extending fastener 722 is provided on the load side terminal 724 for use in securing the load conductor to the terminal 724. For example, the fastener 722 may be a bolt or stud extending forward from the rear of the terminal 724 through an aperture therein. The stud may be pressed on the terminal 724 to create an interference fit between its body and the terminal 724, thereby preventing loss of the stud during shipping and installation.

A rearward-extending mounting fastener 720 is provided for securing the rear portion of the housing 730 to a structural member of the distribution panel (not shown). The internal walls of the housing 730 form an interference-free region 733 to permit access to the fastener 720 from the front of the disconnect when the fuse holder assembly 702 is removed. Upper and lower mounting ears 712, 716, are provided to secure the front of the housing 130 to structural members of the distribution panel. Suitable apertures 710, 714 are formed in the mounting ears 712, 716 to receive appropriate mounting fasteners.

A suitable insulating barrier plate 707 is preferably provided in the housing to prevent undesired access to terminals 744, 746 when fuse holder 700 has been removed. Apertures **707*a*, 707*b* are provided in barrier plate 707 to receive fuse-holder contacts 706, 708. Preferably, apertures 707*a*, 707*b*** are shaped and sized to prevent unintentional insertion of foreign objects.

The fuse holder assembly 702 comprises a body 742 including a handle portion, a protection fuse 704, and appropriate contacts 706, 708 for electrically connecting the fuse 704 to mating contacts 744, 746 in the disconnect housing 730. The mating contacts 744, 746, are in turn electrically connected to the line side terminal 726 and the load side terminal 724. Thus, when installed, the fuse holder assembly 702 completes an electrical path between the line side terminal 726 and the load side terminal 724.

Fuse 704 is preferably a telecommunication fuse having appropriate amperage for the power supply circuits being controlled. For example, for medium-amperage applications, the fuse may be a conventional fuse having blade-type contacts and may have a maximum current rating of 250 Å. However, other fuse configurations may be appropriate for higher-current applications. The alarm fuse 738, protection fuse 704, and external terminals 726, 724, and 736 are electrically connected in the same manner as previously described for the corresponding elements of disconnects 100, 300.

Figure 19:
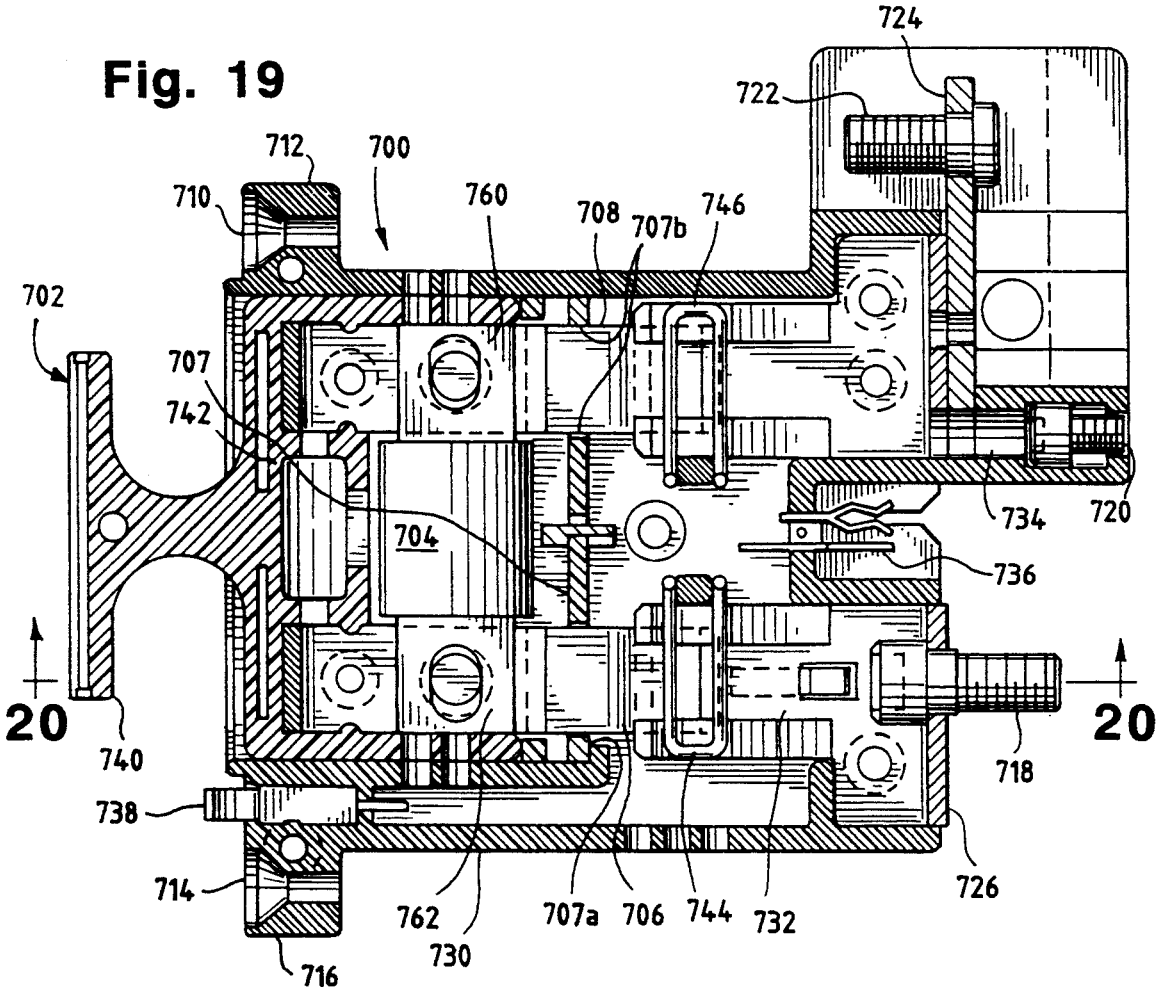
FIG. 19 is a side cross-section view of the disconnect device of FIG. 18 taken along the view lines 19—19 thereof.
Figure 20:
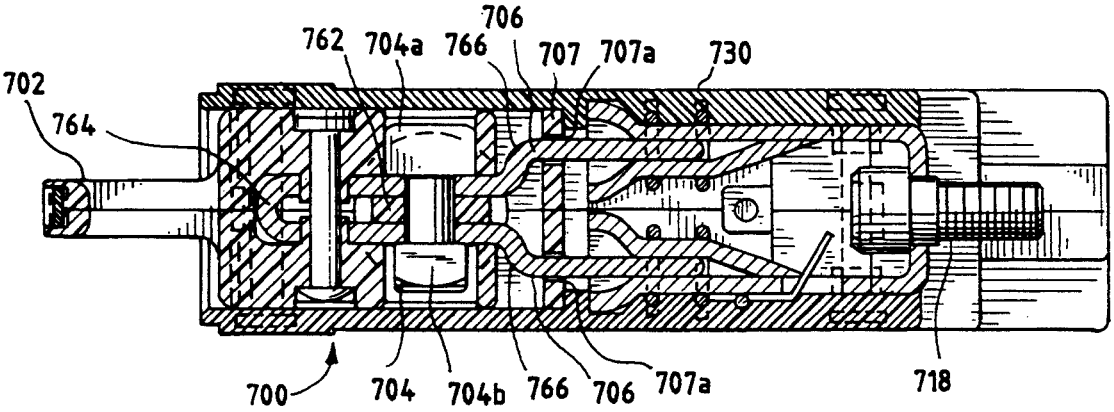
FIG. 20 is a bottom cross-section view of the disconnect device of FIG. 18 taken along the view lines 20—20 of FIG. 19.
Figure 21:
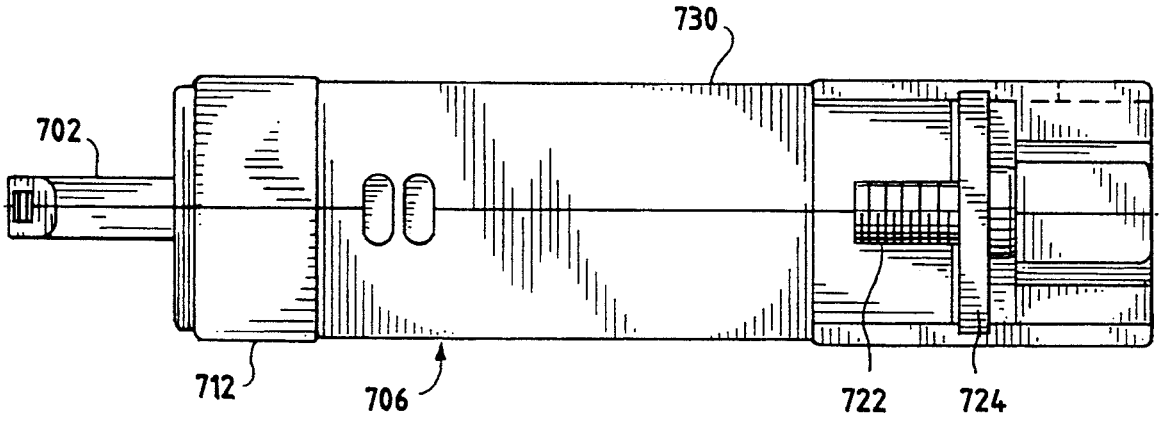
FIG. 21 is a top plan view of the disconnect device of FIG. 18.
Figure 22:
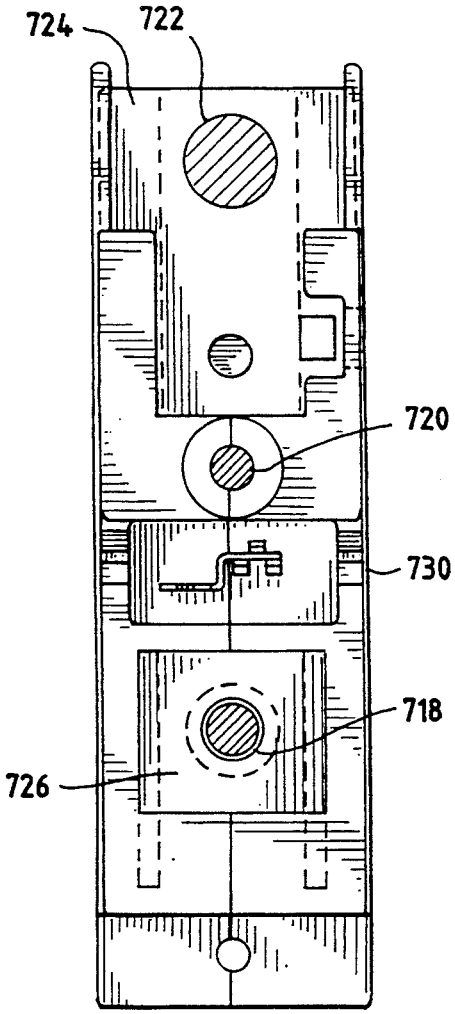
FIG. 22 is a rear elevation view of the disconnect device of FIG. 18.

Fuses and conductors carrying large currents operate at elevated temperatures, and in prior art devices this may cause mechanical interfaces between the fuse contacts and the fuse-holder contacts to loosen over time. Accordingly, when fuses are used in high-current applications, positive securing methods are required to assure continuous, high-quality electrical connections between their contacts and the fuse-holder contacts with which they are used. As best seen in FIGS. 19–20, an exemplary high-current fuse 704 has blade-type contacts 760, 762 which permit large contact surfaces at the interface between the contacts 760, 762 and the fuse-holder contacts 706, 708. In this embodiment, the fuse holder contacts 706, 708 provide a single male-type contact, in contrast to the multiple female-type contact of fuse holder 400. However, The line side and load side terminals 724, 726 of housing 730, which engage the fuse-holder contacts 706, 708, are configured as multiple female-type contacts.

In order to provide a highly-secure mechanical and electrical connection between the fuse the the fuse-holder contacts 706, 708, the fuse-holder contacts 706, 708 are formed in a modified-Y-shaped configuration. The fuse-holder contacts 706, 708 extend forward toward the front of the fuse holder 700, bend inward at 766, extend forward again to pass adjacent the blade-type fuse contacts 762, 760 and wrap around those contacts at 764. Thus, each of the fuse-holder contacts 706, 708 straddles a corresponding fuse contact 762, 760, thereby providing a large-surface-area electrical connection on both sides of the fuse contacts 762, 760.

In order to maximize the contact surface area and to provide a continuous, high-quality connection between these parts, suitable fasteners **704*a*, 704*b* are provided to provide signficant clamping pressure to compress the fuse-holder contacts 706, 708 against the fuse contacts 762, 760. For example, fastener 704*a* may be a threaded bolt extending through the fuse contacts 762, 760 and the fuse-holder contacts 706, 708, and fasteners 704*b* may be a mating nut which may be tightened to place the contacts 706, 708 in secure mechanical and electrical engagement with contacts 762, 760**. This forces the entire adjacent surfaces of these parts into electrical contact, providing high current-carrying capacity and reducing resistive heating in the contact area.

The above-described embodiment of the invention is merely one example of a way in which the invention may be carried out. Other ways may also be possible, and are within the scope of the following claims defining the invention.

What is claimed is:

1. A power supply disconnect device for installation in a power supply distribution panel having at least one power supply bus means, said disconnect device comprising:

a housing;

load side terminal means extending from said housing;

line side terminal means extending from said housing for electrical connection to said power supply bus means;

alarm terminal means extending from said housing;

a protection fuse holder assembly removably installed in said housing;

an alarm fuse means independently removably installed in said housing, whereby said protection fuse holder assembly is removable without removing said alarm fuse means;

said alarm fuse means connected in parallel with said protection fuse assembly.

2. The disconnect of claim 1 which is front-mounted.

3. The disconnect of claim 1 which is rear-mounted.

4. The disconnect of claim 1 wherein said protection fuse holder assembly has a body portion, a handle portion attached to said body portion, a cavity within said body portion for containing at least one spare fuse means, a cover for said cavity, first and second fuse contacts attached to said body portion.

5. The disconnect of claim 1 wherein said fuse holder assembly has first and second fuse contacts for contacting and for mechanically retaining a fuse means, first and second fuse holder terminal means, electrically connected to said first and second fuse contacts respectively, and at least one of said first and second contacts being integral with said respective first and second fuse holder terminal means.

6. The disconnect of claim 5 wherein at least one of said first and second fuse holder terminal means has two opposed trifurcated contact blades extending from said body.

7. The disconnect of claim 5 wherein at least one of said first and second fuse holder terminal means are male terminals.

8. The disconnect of claim 1 wherein said disconnect housing has first, second, and third alarm fuse contacts, first and second fuse holder terminals; said first fuse holder terminals and said first alarm contact connected to said load side terminal means of said disconnect housing;

said second fuse holder terminal and said second alarm contact being electrically connected to said line side terminal means of said disconnect housing; and said third alarm contact being electrically connected to said alarm terminal means of said housing.

9. The disconnect of claim 1 wherein said disconnect housing has means on said disconnect side wall housing to maintain a spaced relationship between side-by-side disconnects wherein less than 30% of a side area of the disconnect housing comes in contact with an adjacent side-by-side aligned disconnect.

10. A power supply disconnect device for installation in a power supply distribution panel having at least one power supply bus means, said disconnect device comprising:

a housing;

load side terminal means extending from said housing;

line side terminal means extending from said housing for electrical connection to said power supply bus means;

alarm terminal means extending from said housing;

first and second cavities formed in said housing;

a protection fuse holder assembly removably installed in said first cavity;

an alarm fuse means removably installed in said second cavity, whereby said protection fuse holder assembly is removable without removing said alarm fuse means;

said protection fuse holder assembly having a body portion, a handle portion attached to said body portion, a cavity within said body portion for containing at least one spare fuse means, a cover for said cavity, first and second fuse contacts attached to said body portion, a protective fuse means having first and second end caps electrically connected to said first and second fuse contacts respectively, each of said first and second fuse contacts having two contacts extending from said body portion for contacting said end caps and for mechanically retaining said fuse means, first and second fuse holder terminal means electrically connected to said first and second fuse contacts respectively, and at least one of said first and second contacts being integral with said respective first and second fuse holder terminal means;

said first cavity having first and second fuse cavity terminals extending toward an opening thereof for electrical connection to said first and second fuse holder terminal means respectively, each of said first and second fuse holder cavity terminals having contacts for electrically and mechanically mating with said first and second fuse holder terminal means, and at least two locator walls for engaging matching locator clearances on said fuse holder assembly;

said alarm fuse means having a handle portion, a load side contact attached to said handle portion, a line side contact attached to said handle portion, and an alarm contact attached to said handle portion;

said second cavity having first, second, and third alarm fuse contacts for respectively mating with said load side contact, said line side contact, and said alarm contact of said alarm fuse means;

said first cavity terminal being electrically connected to said load side terminal means of said housing and said first terminal means of said second cavity;

said second cavity terminal being electrically connected to said line side terminal means of said housing and said second terminal means of said second cavity;

said third terminal means of said second cavity being electrically connected to said alarm terminal means of said housing;

said housing further comprising a downward extending tab for securing said housing to a first structural member of said power supply distribution panel, a projection extending rearward from the said housing for securing said housing to a second structural member of said power supply distribution panel, said projection including fastener means extending rearward from said projection to engage a receptacle in said second structural member, said housing having an aperture extending from a front wall of said housing to said fastener means to allow access to said fastener means from the front of said housing, said line side terminal further comprising second fastener means extending rearward from said line side terminal to engage a receptacle in said power supply bus means, said housing having an aperture extending from a front wall of said housing to said second fastener means to allow access to said second fastener means from the front of said housing;

and said load side terminal further comprising third fastener means extending forward from said load side terminal to engage a load conductor, said housing being shaped to permit access to said third fastener means from the front of said housing.

11. The disconnect of claim 10 wherein at least one of said first and second fuse holder terminal means has two opposed trifurcated contact blades.

12. The disconnect of claim 11 wherein at least one of said first and second fuse holder terminal means is a male terminal.

13. The fused disconnect comprising:

a housing;

a line side terminal attached to said housing;

a load side terminal attached to said housing;

an alarm terminal attached to said housing;

removable protection fuse means for completing an electrical current path between said line side terminal and said load side terminal; and alarm generating means responsive to removal of said protection fuse means for supplying an alarm signal to said alarm terminal, whereby said alarm signal is supplied even when said protection fuse is removed.

14. The disconnect of claim 13 wherein:

said alarm generating means is responsive to overload operation of said protection fuse means for continuously supplying an alarm signal to said alarm terminal regardless of subsequent removal of said protection fuse means.

15. The fused disconnect device of claim 13 wherein said protection fuse means comprises a protection fusible element adapted for one-time operation and thereafter requiring replacement with a spare protection fusible element;

said alarm generating means comprising an alarm fusible element adapted for one-time operation and thereafter requiring replacement with a spare alarm fusible element;

said protection fuse means further comprising means for storing at least one spare protection fusible element and at least one spare alarm fusible element.

16. The fused disconnect device of claim 13 which is adapted for front access installation into a power distribution panel and wherein said line side terminal is adapted for direct mechanical and electrical contact with a power supply bus bar of the power distribution panel.

17. The device of claim 16, wherein:

said line side terminal further comprises means for fastening said line side terminal to said power supply bus bar, said housing forming a cavity adapted to permit access to said fastening means from a front side thereof, whereby said fastening means may be secured to said power supply bus bar.

18. The device of claim 17, wherein:

said housing comprises means for fastening said device to a structural member of said power distribution panel, said housing forming a cavity adapted to permit access to said fastening means from a front side thereof, whereby said fastening means may be secured to said structural member.

19. The fused disconnect device of claim 13 which is adapted for rear access installation into a power distribution panel and wherein said line side terminal is adapted for direct mechanical and electrical contact with a power supply bus bar of the power distribution panel.

20. The device of claim 19, wherein:

said line side terminal further comprises means for receiving a fastening means for attaching said line side terminal to said power supply bus bar, said power supply bus bar having fastener means for extending through an aperture therein to engage said receiving means, said fastening means having a portion extending rearward of said power supply bus bar to provide access from a rear side of said panel, whereby said fastening means may be secured to said receiving means.

21. A protection fuse holder assembly to be removably installed in a disconnect comprising;

a body portion, a handle portion attached to said body portion, a cavity within said body portion for containing at least one spare cartridge fuse means, a cover for said cavity, and first and second fuse contacts attached to said body portion:

said first and second fuse contacts having two blade contacts extending from said body portion for contacting said end caps and for mechanically retaining said fuse means, and first and second fuse holder terminal means electrically connected to said first and second fuse contacts respectively; said first and second fuse holder terminal means each having two opposed sets of trifurcated contact blades extending from said body.

22. The fuse holder assembly of claim 21 wherein said cavity is adapted to also contain a spare cartridge fuse and a spare alarm fuse.

23. A telecommunication protection fuse holder assembly to be removably installed in a fused telecommunication disconnect comprising:

a body portion and a handle portion attached to said body portion, first and second fuse holder contacts extending from said body for contacting and retaining a cartridge type fuse, first and second terminals electrically connected to said first and fuse holder contacts respectively, at least one of said first and second contacts being integral with said respective first and second terminals, at least one of said first and second terminals being a multiple contact female terminal, and a cavity within said body portion constructed to contain a spare cartridge fuse and a spare alarm fuse.

24. A telecommunication protection fuse holder assembly to be removably installed in a fused telecommunication disconnect comprising:

a body portion and a handle portion attached to said body portion, first and second fuse holder contacts extending from said body for contacting and retaining a cartridge type fuse, first and second terminals electrically connected to said first and fuse holder contacts respectively, at least one of said first and second contacts being integral with said respective first and second terminals, at least one of said first and second terminals being a multiple contact female terminal, and said female terminal is two opposed trifurcated contact blades extending from said body.

* * * * *